US007073809B2

(12) United States Patent
Holzer

(10) Patent No.: US 7,073,809 B2
(45) Date of Patent: Jul. 11, 2006

(54) SNOWBOARD BINDING

(75) Inventor: Helmut Holzer, Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 71 days.

(21) Appl. No.: 10/347,613

(22) Filed: Jan. 17, 2003

(65) Prior Publication Data

US 2003/0141701 A1 Jul. 31, 2003

(30) Foreign Application Priority Data

Jan. 18, 2002 (AT) ..... A 89/2002

(51) Int. Cl.
*A63C 5/00* (2006.01)

(52) U.S. Cl. ..... 280/607; 280/617; 280/618; 280/14.21; 280/14.22; 280/633; 280/634

(58) Field of Classification Search ..... 280/607, 280/617, 618, 14.21, 14.22, 633, 634
See application file for complete search history.

(56) References Cited

U.S. PATENT DOCUMENTS

| | | | | |
|---|---|---|---|---|
| 5,156,644 | A * | 10/1992 | Koehler et al. | 280/14.23 |
| 5,356,170 | A * | 10/1994 | Carpenter et al. | 280/618 |
| 5,560,633 | A * | 10/1996 | McGowan | 280/614 |
| 5,660,410 | A | 8/1997 | Alden | |
| 5,727,797 | A * | 3/1998 | Bowles | 280/14.21 |
| 5,758,895 | A * | 6/1998 | Bumgarner | 280/607 |
| 5,941,553 | A * | 8/1999 | Korman | 280/613 |
| 6,007,077 | A * | 12/1999 | Moe | 280/14.22 |
| 6,364,323 | B1 * | 4/2002 | Coulter | 280/14.22 |
| 6,394,484 | B1 * | 5/2002 | Maravetz et al. | 280/624 |
| 6,733,031 | B1 * | 5/2004 | Okajima et al. | 280/613 |
| 6,840,532 | B1 * | 1/2005 | Plassiard | 280/623 |
| 6,886,849 | B1 * | 5/2005 | Mandon | 280/618 |
| 2001/0015543 | A1 | 8/2001 | Joubert Des Ouches | |
| 2003/0146600 | A1 * | 8/2003 | Holzer | 280/618 |
| 2004/0119265 | A1 * | 6/2004 | Draper et al. | 280/618 |
| 2004/0227328 | A1 * | 11/2004 | Carrasca | 280/618 |
| 2004/0262887 | A1 * | 12/2004 | Bianchi Bazzi | 280/617 |

FOREIGN PATENT DOCUMENTS

| | | |
|---|---|---|
| EP | 0 793 920 | 9/1997 |
| EP | 0 824 942 | 2/1998 |
| EP | 1 127 592 | 8/2001 |
| FR | 97 05474 | 7/1998 |
| JP | 09108398 | 4/1997 |

* cited by examiner

*Primary Examiner*—J. Allen Shriver
*Assistant Examiner*—Cynthia F. Collado
(74) *Attorney, Agent, or Firm*—Collard & Roe, P.C.

(57) ABSTRACT

A snowboard binding comprises base plate with an extension in the peripheral regions on either side of its longitudinal axis, and a U-shaped support element, each extension retaining a respective leg of the support element, which supports a back support pivotably disposed in the region of the support element base and/or which is a stop restriction for a back support mounted on the extensions of the base plate. A pivot bearing mounts the support element so as to be pivotable in a limited pivot path about a pivot axis extending transversely to the longitudinal axis and parallel to the base plate. The binding comprises an adjusting and locking mechanism for fixing the support element in a desired angular position relative to the base plate, and/or an elastically resilient damping mechanism for rebounding the support element into a pre-defined angular position relative to the base plate.

27 Claims, 8 Drawing Sheets

SNOWBOARD BINDING

BACKGROUND OF THE INVENTION

1. Field of the Invention

The invention relates to a snowboard binding comprising a base plate for supporting a sports shoe, which has at least one extension in the peripheral regions of the base plate on either side of its longitudinal axis for retaining a respective leg of a U-shaped support element, and this support element supports a back support in the region of its base and is pivotable to a limited degree, and may act as a stop restriction for a back support mounted on the extensions of the base plate.

2. The Prior Art

Numerous binding mechanisms are known for board-type runner devices which are used on their own, in particular so-called snowboard bindings, and have a base plate by means of which the binding mechanism can be mounted on the snowboard. This base plate more or less corresponds in shape and size to the shoe sole of a correspondingly designed sports shoe. As a rule, this base plate is slightly shorter than the sole length of the sports shoe which has to be attached to and released from it. Extensions project vertically from the standing plane in the lengthways peripheral regions of the base plate. These extensions are preferably integrally formed on the base plate and may be provided as retaining extensions extending continuously in the two peripheral regions or raised at the centre to form a support frame which is U-shaped as seen in plan view. This U-shaped support frame is intended to surround the heel region of the sports shoe and can be individually adjusted and fixed in the lengthwise direction of the binding relative to the base plate in order to be adapted to different shoe sizes. To this end, several mutually spaced orifices for fixing screws or longitudinal slots are provided in the peripheral extensions or in the two legs of the support frame, as described in patent specification EP 1 127 592 A1, for example. This binding mechanism also has a so-called back support, by means of which the user of the binding mechanism is supported in the rearward direction. This back support may be mounted directly on the extensions and pivots about a pivot axis extending transversely to the binding longitudinal axis, limited by stops, or this pivot bearing is provided directly on the U-shaped support frame. The stop restriction for the support in the rearward direction is provided by means of a stop element acting on the support element, which moves so that it bears on the U-shaped support frame, thereby limiting the pivoting motion of the support. Binding mechanisms of this type are usually provided with a strap arrangement and/or with automatic coupling mechanisms to form so-called "step-in" bindings. The disadvantage of these binding mechanisms is that they can be adapted to the individual requirements of the user to a limited degree only.

SUMMARY OF THE INVENTION

The underlying objective of the present invention is to propose a snowboard binding, which can be more readily adapted to the individual wishes and requirements of a whole range of different users.

This objective is achieved in a snowboard binding of the first-described structure by providing a pivot bearing mounting the support element so as to pivot to a limited degree about a pivot axis extending transversely to the longitudinal axis and substantially parallel with the base plate. The support element can be fixed in the desired angular position relative to the base plate by means of an adjusting and locking mechanism and it may be forced into a pre-defined angular position relative to the base plate by means of an elastically resilient damping mechanism.

One of the advantages of the snowboard binding proposed by the invention resides in the fact that the support element for the back support can be individually adjusted, at least in terms of its angular position relative to the base plate, within predefined limits about a pivot axis extending transversely to the longitudinal axis. This may be achieved with a damping mechanism providing an elastic and resilient damping and rebound action for relative displacements between the support element and base plate. This enables different angles of inclination to be set between the back support and the base plate which provides a standing plane for the shoe of the user. On the other hand, an adjustable and fixable pivot bearing for the support element also allows the back support to be set to a certain degree at different support heights. The adjusting and locking mechanism and the damping mechanism may be used alternatively, or in combination. With the damping mechanism, impact stress in the force-coupled interaction between the user and the snowboard can be damped within predefined limits. This counteracts premature tiring of the user or the occurrence of unpleasant pressure points on the feet of the user to a certain extent.

It is advantageous to provide the pivot bearing for the support element at the ends of its two legs remote from the base, since this enables loads acting on the pivot bearing to be kept relatively low, thereby providing a relatively simple and compact binding structure capable of withstanding any stress which occurs without difficulty. This design also offers a relatively broad range within which the desired support height of the back support can be adjusted relative to the standing plane.

Alternatively, the pivot bearing may be close to the base of the U-shaped support element to provide a relatively broad range for setting and adjusting the angle of inclination of the back support.

The adjusting and locking mechanism for fixing the support element in different angular positions relative to the base plate may be advantageously disposed at a distance from the pivot bearing, because the loads acting on the adjusting and locking mechanism can thereby be minimised to provide a strong binding mechanism with simple and compact features.

In another embodiment of the snowboard binding, at least one resiliently elastic damping element is provided inside the pivot path of the support element, which enables the support element to be pivoted about the pivot axis against the bias of the damping element when subjected to compression forces perpendicular to a support surface of the back support, which is of advantage because loads which occur during use of the snowboard binding are damped and rearward positions and/or forward positions of the user can be resiliently damped to a certain degree, which provides greater comfort during use.

It is of advantage that the adjusting and locking mechanism and/or the damping mechanism is disposed in the end of the base plate nearest to the base because the adjusting and locking mechanism and the damping mechanism can be spaced at a relatively long distance from the pivot bearing and will therefore be able to withstand the stress which occurs during use of the snowboard without any difficulty.

The legs of the support element may extend continuously from a rearward to a forward region of the base plate supporting the balls of the feet, which is of advantage because it gives the base plate high strength and bending strength, enabling savings to be made in terms of the dimensions and/or amount of material used for the base plate. This enables the weight of the snowboard binding as a whole to be optimised and reduced.

The visual appearance is made attractive and effective lateral support for a sports shoe is provided using a relatively small volume of material for the support element if the legs of the support element are convexly curved relative to the base plate.

If the base plate has additional extensions in the peripheral regions of the base plate for forming the pivot bearing and the extensions retaining the legs are arranged at a distance apart to receive the damping mechanism and/or the adjusting and locking mechanism, the weight and material requirements for providing the base plate with the extensions can be kept as low as possible whilst nevertheless affording a statically favourable and stable binding mechanism.

In one embodiment of the snowboard binding, the adjusting and locking mechanism has at least one oblong orifice in a plane perpendicular to the base plate for adjusting the angular position of the support element relative to the base plate, which has the advantage of enabling a stepless angular adjustment of the support element. The effort involved in changing the binding setting is reduced and there is no need for any dismantling operations in order to change a setting.

In another advantageous embodiment of the snowboard binding, the adjusting and locking mechanism comprises an insert part which can be inserted in the oblong hole and determines the angular position of the support element depending on the position in which it is inserted. This enables the support element to be very securely fixed in the desired angular position with low clamping and retaining forces. The desired angular positions can be selected depending on the insert part used or depending on the position in which it is inserted. Tightly fitting insert stop elements reduce the risk of the adjusting and locking mechanism inadvertently working loose or being released as a result of careless adjustment to a minimum. In particular, it is not necessary to secure the adjusting and locking mechanism with a specific minimum torque in order to ensure that a setting is securely locked.

The insert part may be a resiliently flexible and rebounding damping element which absorbs stress occurring in the binding mechanism during active use, affording a simply structured and reliable damping mechanism which can be replaced by a rigid adjusting and locking mechanism if desired. Another advantage is that because the insert part can be easily changed, different damping characteristics may be provided. Also of advantage is the fact that the support element is not able to move freely, ensuring that the sports shoe is firmly retained in the binding mechanism without wobbling.

It is possible to dismount from the snowboard binding rapidly and without effort if the snowboard binding comprises at least one connecting element operable without tools, in particular at least one strap arrangement and/or at least one coupling part, for securing and releasing the sports shoe.

A very strong and simply designed pivot axis, which also permits different pivot bearings and pivot positions, is defined by a screw bolt fixing means.

In one embodiment of the snowboard binding, the damping mechanism and/or the adjusting and locking mechanism comprises at least one screw bolt connecting element between the support element legs and the base plate extensions which is adjustable to a limited degree in an oblong hole. This provides a binding mechanism which can be assembled easily and without difficulty in spite of the additional functions and operating mechanisms.

The number of separate constituent connecting elements between the support element and the base plate can be kept to an absolute minimum as a result of another embodiment of the snowboard binding in which the pivot bearing is provided in the form of rounded guide surfaces on the ends of the legs, and/or by arcuately curved bearing surfaces on the base plate extensions. The binding mechanism can also be assembled more rapidly and easily as a result.

The maximum possible pivot path of the support element and/or the hardness of the damping mechanism can be varied by means of an adjusting element which may be an adjustable stop element for the support element legs, and/or a positioning means for varying the initial tension or damping characteristic of the damping mechanism. The damping characteristic of the binding mechanism can be adapted to individual needs and requirements without having to make any modifications or replacements.

A simple design of a damping mechanism that is also gentle on the damping element can be obtained if its hardness and/or the maximum pivot path of the support element can be adjusted by varying a radial distance of the damping mechanism from the pivot axis. In addition, this feature permits a more extensive adjustment range of the damping characteristic.

Also of advantage is another embodiment of the snowboard binding, in which the adjusting element has a manually operable handle enabling the setting of the hardness of the damping mechanism and/or the maximum pivot path of the support element to be varied without the need for tools, since the properties of the binding mechanism can also be varied effortlessly whilst the binding mechanism is in use during travel in open terrain.

In another advantageous embodiment, the snowboard comprises two pivot bearings between the support element and the base plate spaced apart from one another in the direction of the longitudinal axis, and guide mechanisms for the pivot bearings between the support element and the base plate so that the support element can be adjusted in rotation and translation relative to the base plate by the pivot bearings and guide mechanisms. This affords an extensive adjustment range between the support element and base plate and the binding mechanism can therefore be adapted to perceptibly varying conditions or to markedly different requirements, e.g. to a plurality of different shoe sizes or to changing requirements in terms of how forces are introduced or transmitted.

Also of advantage is an embodiment, in which at least one of the guide mechanisms, preferably the rearward guide mechanism, rises from the ends of the leg in a direction towards the base of the support element, since this enables the support height of the back support to be varied and simultaneously improves the way force is introduced or transmitted between the foot of the user and the snowboard in the rear region of the binding mechanism.

If the guide mechanisms are arcuately curved and have a center point above the base plate, the ratio between a change to the support height and a change in the length of the binding mechanism and the point at which force is introduced can be varied in a disproportionate and non-linear manner.

Advantageously, the guide mechanisms are cutouts or orifices in the extensions, and the pivot bearings have bolt- or pin-type fixing means disposed therein to provide a technically simple yet robust combined pivoting and sliding mounting between the support element and the base plate.

The pivot axes maybe displaceably received in sliding blocks adjustably mounted in the guide mechanisms, which means that the surface contact acting on the guide surfaces of the guide mechanisms can be reduced, thereby ensuring perfect operation on a long-term basis.

BRIEF DESCRIPTION OF THE DRAWINGS

The invention will be described in more detail below with reference to preferred embodiments illustrated in the appended drawing wherein.

DETAILED DESCRIPTION OF PREFERRED EMBODIMENTS

Figure 1:
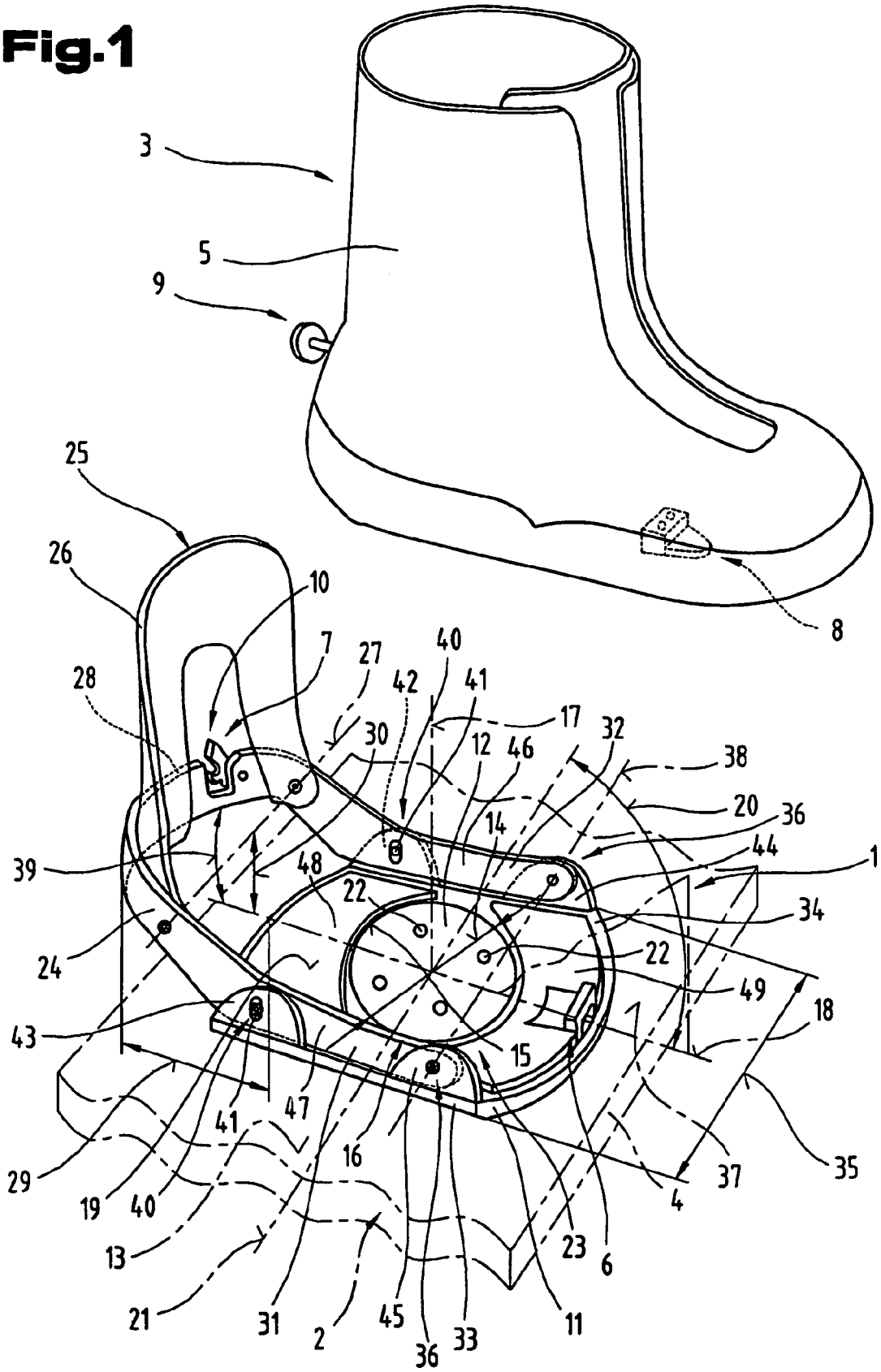
FIG. 1 is a simplified, perspective showing of an embodiment of a snowboard binding with a pivot bearing for the support element supportive the back support.

The same parts described in the different embodiments are denoted by the same reference numbers and the same terms are used throughout the description for like parts bearing the same reference numbers. Furthermore, the positions chosen for the purposes of the description, such as top, bottom, side, etc, relate to the drawing specifically being described and can be transposed to a new position when another position is being described. Individual features or combinations of features in the illustrated and described embodiments may be construed as independent inventions.

FIG. 1 shows a perspective view of a binding 1 for releasably connecting a board-type sports device 2 to a sports shoe 3. The sports device 2 is a snowboard 4, on which the binding 1 is to be mounted so that it can be releasably connected to a snowboard shoe 5 of an appropriate design.

The binding 1 has coupling parts 6, 7 for establishing a releasable connection with matching coupling parts 8, 9 on the sports shoe 3. The coupling parts 6, 7, 8, 9 may be a latch coupling 10 or so-called "step-in system" which can be operated without tools, enabling sports shoe 3 and binding 1 to be comfortably and rapidly connected and released.

The coupling parts 6, 7 of the binding 1 may alternatively be replaced by at least one strap arrangement known per se. These known strap arrangements have at least one strap-shaped tensioning element with a buckle or some other clamping mechanism, by means of which the sports shoe 3 can be securely strapped in the binding 1 and then released again to dismount from the binding 1.

The coupling part 9 of the sports shoe 3 may be a bolt-shaped extension in the heel region, for example. The other coupling part 8 on the sports shoe 3 may be a tongue-type retaining extension on the sole, which can be located in a positive engagement with a recess or retaining tab on the binding 1. The other coupling part 7 of the binding 1 may be provided in the form of a pivotably mounted hooking element displaceable in conjunction with the heel-side coupling part 9, of a type long since known from the prior art.

The binding 1 also comprises a substantially flat base plate 11, which is attached to the top face 13 of the snowboard 4 by means of a retaining plate 12. As seen in plan view, the base plate 11 preferably has a contour that is substantially the same shape as the shoe sole. However, it would also be possible for the base plate 11 to be designed in the form of a beam-shaped support, with coupling elements at its end regions for connecting it to a correspondingly designed shoe.

The retaining plate 12 for securing the base plate 11 and the entire binding 1 to the snowboard 4 has a circular contour as seen in plan view. A thickness of the wheel-like retaining plate 12 corresponds more or less to a thickness of the base plate 11. A diameter 14 of the retaining plate 12 may be 70 mm to 140 mm, preferably approximately 105 mm.

In its central region, the base plate 11 has a circular orifice 15 or a corresponding recess, the diameter of which essentially corresponds to the diameter 14 of the retaining plate 12. The retaining plate 12 and the base plate 11 can be at least partially inserted one in the other and connected in a positive fit in the recess or orifice 15. The circular retaining plate 12 together with the complementary orifice or bore 15 forms a lockable and releasable rotary bearing 16 for the base plate 11 relative to the top face 13 of the snowboard 4. In particular, this rotary bearing 16 forms an axis 17 disposed substantially perpendicular to the base plate 11 and the top face 13 of the snowboard 4, extending parallel and congruently with the binding vertical axis.

The base plate 11 preferably conforms to the sole shape of the sports shoe 3 and is asymmetrical relative to longitudinal axis 18 of the base plate. This longitudinal axis 18 preferably extends through the centre of the retaining plate 12 and is substantially parallel with a standing plane 19 for the sports shoe 3. The standing plane 19 for the sports shoe 3 on the base plate 11 may extend substantially parallel with the top face 13 of the snowboard 4 or may be disposed at an oblique angle to the top face 13 of the snowboard 4 to produce what is known as a "canting".

The selectively lockable and releasable rotary bearing 16 between the retaining plate 12 and the base plate 11 enables the angle of rotation of the binding mechanism 1 to be set in different positions relative to the snowboard 4. In particular, an angle of rotation 20 between the longitudinal axis 18 and a longitudinal axis 21 of the snowboard 4 can be set as desired by the user in a known manner and the desired angle of rotation 20 fixed. In particular, this rotary bearing 16 enables the angle of rotation 20 to be adjusted from the "Regular" to the "Goofy" angular position and vice versa. Similarly, this rotary bearing 16 enables the binding longitudinal axis 18 to be changed from a parallel alignment with the longitudinal axis 21 to a position disposed transversely or perpendicular to the longitudinal axis 21. Basically, however, this rotary bearing 16 may be designed so that it can be released and locked without stops so that the angle of rotation 20 can be set in an adjustment range of 360°.

In a known manner, at least two binding mechanisms 1, either identical in design or specially adapted for the right and left foot, are mounted on a snowboard 4. To this end, it is usually necessary to provide a plurality of fixing screws 22, which extend through the retaining plate 12 and can be anchored in the snowboard 4 in order to secure the binding mechanism 1 to the top face 13. In the designs known from the prior art, the fixing screws 22 also fulfill the function of an adjusting and fixing mechanism 23 for the angle of rotation 20 and the rotary bearing 16.

The binding 1 also comprises a support element 24, which is U-shaped as seen in plan view, for a support 25 which extends essentially perpendicular to the base plate 11. This support 25 is preferably a flat element with a cambered cross section and is intended to support the calf region of a user and the rear region of the sports shoe 3. Generally speaking, the support 25 is therefore also referred to as back support 26 or a so-called "high-back".

The back support 26 is able to pivot to a limited degree about a pivot axis 27 extending substantially transversely to the longitudinal axis 18 and substantially parallel with the standing surface 19 of the base plate 11. In particular, a pivoting action of the back support is restricted in a direction away from the base plate 11 to the rear, preferably by means of an individually adjustable stop element—not illustrated. The supporting action of the back support and the introduction of force and force transmission between the user and the snowboard 4 can be optimally adjusted to individual needs and different requirements.

In order to minimise space requirement, the back support which essentially stands up vertically from the standing plane 19 of the base plate 11 during use can be pivoted in a known manner to a collapsed or folded position, in which the back support assumes a space-saving position, making the snowboard 4 easier to transport.

The back support is mounted so as to transmit load and forces to the support element 24. The back support is mounted in the region of a base 28 of the U-shaped support element 24.

The base 28 of the support element 24 preferably sits at a distance 29 behind the rearmost point of the base plate 11 in the direction of longitudinal axis 18 during normal use. In other words, the support element 24 usually projects beyond the rearmost point of the base plate 11 and in doing so bears the back support at a vertical distance 30 above the standing plane 19. The two legs 31, 32 of the support element 24 extend along the base plate 11 at the lengthwise peripheral regions 33, 34. A distance between the two parallel legs 31, 32 thus corresponds more or less to a width 35 of the base plate 11 and essentially the width of sports shoe 3 with which it is used.

The key factor is that a pivot bearing 36 is provided for the support element 24, which permits a limited pivoting action of the support element 24 in a vertical plane 37. To this end, at the ends of the two legs 31, 32 remote from the base 28, the pivot bearing 36 forms a pivot axis 38 extending substantially transversely to the longitudinal axis 18 and substantially parallel with the standing plane 19 of the base plate 11, and the pivot bearing mounts the support element 24 so as to be pivotable together with the back support in a limited pivot path. In particular, the pivot bearing 36 enables an angular position 39 of the support element 24 to be adjusted and fixed and/or varied relative to the base plate 11 as a result of force induced during use. The pivot axis 38 of the pivot bearing 36 is preferably defined by bolt-type or screw-like connecting elements between the support element 24 and the base plate 11. Naturally, it would also be possible to use pivot bearings 36 of any other known type. For example, the ends of the legs 31, 32 might have rounded guide surfaces engaging matching arcuately curved bearing surfaces on the base plate 11.

The angular position 39 can be adjusted and fixed by means of an adjusting and locking mechanism 40 depending on individual desires and to suit different requirements. The desired setting of angular position 39 may be fixed rigidly or alternatively—as will be described in more detail below—in a resiliently elastic manner under the action of displacement forces or loads. The adjusting and locking mechanism 40 used for this purpose may be mounted directly on the pivot bearing 36. By preference, however, the adjusting and locking mechanism 40 is spaced at a distance apart from the pivot bearing 36 so as to absorb any forces which occur more easily and make it easier to withstand loads. Preferably, the adjusting and locking mechanism 40 is arranged at the end of the base plate 11 nearest base 28 of support element 24 and is positioned more or less at half the length of the legs 31, 32.

The adjusting and locking mechanism 40 preferably has at least one mechanical clamping and catch connection 41 between the legs 31, 32 of the support element 24 and extensions 42, 43 of the base plate 11. Different angular positions 39 can be set and fixed between the base plate 11 and the support element 24 pivotably mounted thereon by means of this clamping and catch connection 41. Different heights of connection 41 produce the desired angular position 39 between the support element 24 and the standing plane 19 for the sports shoe 3 on the base plate 11. The clamping and catch connection 41 has at least two corresponding clamping and catch surfaces, which together can fix whatever angular position 39 is assumed when sufficient tensioning force is applied and thus lock the pivot bearing 36. The adjusting and locking mechanism 40 is preferably provided in both lengthwise peripheral regions 33, 34 for each of the two legs 31, 32. The bracket-type extensions 42, 43 are disposed perpendicular to the standing plane 19 of the base plate 11 and form the clamping and catch surfaces for the legs 31, 32. The operating element for the clamping and catch connection 41 may be a screw, an eccentric lever or any other known clamping element. In order to increase the retaining and fixing forces, the co-operating retaining or clamping surfaces may be provided with friction-enhancing means, such as roughened or rubberised areas and/or teeth.

At its forward end and in the peripheral regions, the base plate 11 has additional extensions 44, 45 for forming the pivot bearing 36 to which the legs 31, 32 are pivotably attached. In order to produce a very strong pivot bearing 36 for the support element 24, each leg 31, 32 may be provided with two extensions 44, 45 spaced at a distance apart from one another, between which the ends of the legs 31, 32 are pivotably received. The extensions 42, 43 also may be arranged in pairs for increasing the breaking strength and retaining force of the adjusting and locking mechanism 40.

By means of the pivot bearing 36 for the support element 24, which can be adjusted and fixed within certain predeterminable limits, the back support 26 can be set to different support heights. Similarly, the height coupling part 7 on the support element 24 can be adjusted relative to the standing plane 19 for the sports shoe 3. What might be termed a "suspended bearing" of the heel region of the sports shoe 3 relative to the base plate 11 can thus be obtained. As a result of a slight distance between the heel of the sole of the sports shoe 3 and the base plate 11 achieved by a lifting action of the coupling part 7 on the support element 24 connected to coupling part 9 of the sports shoe 3, loads in the vertical direction between the foot of the user and the snowboard 4 may be absorbed or damped. The flexibility of the coupling part 9 in the direction perpendicular to the shoe sole and/or an elastic bearing of the coupling part 7 on the support element 24 or and/or a certain intrinsic elasticity of the support element 24 can be used to provide resilient support for the heel region of the sports shoe 3.

However, instead of using this resiliently elastic mounting for the sports shoe 3, the pivot bearing 36 may be designed to adapt the coupling mechanism 7 to different sizes and types of sports shoes 3 by means of another design of the pin-like coupling part 9. In particular, the pivot bearing 36 for the support element 24 may be designed so that a single type of binding 1 can be adapted to a plurality of different sports shoes 3 under certain circumstances, by varying the height of the coupling part 9 relative to the shoe sole.

Instead of or in combination with a rigid pivot bearing 36 achieved by a clamping and catch connection 41, it would also be possible to provide an elastically resilient pivot path for the support element 24 relative to the base plate 11 under the action of a damping element. When sufficiently high adjusting forces are periodically applied or occur, a resiliently elastic pivoting of the support element 24 along with the back support can be produced about the pivot axis 38. Pulsating impacts acting on the calves of a user can thus be damped, thereby counteracting the premature occurrence of unpleasant pressure points.

The support element 24 with the two legs 31, 32 and the base 28 connecting them is preferably made in a single piece and is made from a high-strength material, such as metal, for example aluminum. The support element 24 may also be made from a high-strength plastics. The legs 31, 32 of the support element 24 extend continuously from the rearward to a forward region of the base plate 11, which supports the balls of the feet. The legs 31, 32 of the support frame 24 form lateral boundary walls 46, 47 in the lengthwise peripheral regions 33, 34 of the base plate 11. These boundary walls 46, 47 stabilise and strengthen the base plate 11 and also help to position a sports shoe 3 in the binding 1 correctly. As will be explained in more detail below, the boundary walls 46, 47 may also be used for mounting strap-type fixing elements for the sports shoe 3.

The lateral boundary walls 46, 47 significantly improve the breaking strength of the base plate 11. It is primarily the orifice 15 in the base plate 11, with a relatively large surface area, which severely weakens the breaking and bending strength of the latter transversely to the longitudinal axis 18 and this reduction in strength or stiffness is at least partially compensated by the legs 31, 32 extending along the base plate 11 and the breaking limit of the base plate 11 is even further increased by means of the legs 31, 32 forming lateral reinforcing webs. The extensions 42 to 45 may therefore be relatively short in relation to the overall length of the base plate 11 and the continuously extending legs 31, 32 of the support element 24. The articulated link via the pivot bearing 36 and the elastically resilient or rigid connection in the region of the adjusting and locking mechanism 40 between the support frame 24 and the base plate 11 therefore plays a significant part in rendering the base plate 11 stiffer.

Extensions 42 to 45 also may extend across longer longitudinal regions of the base plate 11 to form peripheral side retaining webs for the support frame 24.

Seating elements 48, 49 form the standing plane 19 of the base plate 11 and may produce a damping action and enhanced adhesion friction of the binding 1 relative to the sports shoe 3 if they form of a "padding" of expanded foam or an elastomer, and seating element 49 forms what is known as a "pedal" used to support the ball region of the feet or the toes in the sports shoe 3 and usually extends the length of the base plate 11. Optionally, this seating element 49 may also be positioned to obtain a slight rise in the standing plane 19 in the end region of the base plate 11 assigned to the toes of a user, in which case this seating element 49 is often also referred to as a "gas pedal".

Figure 2:
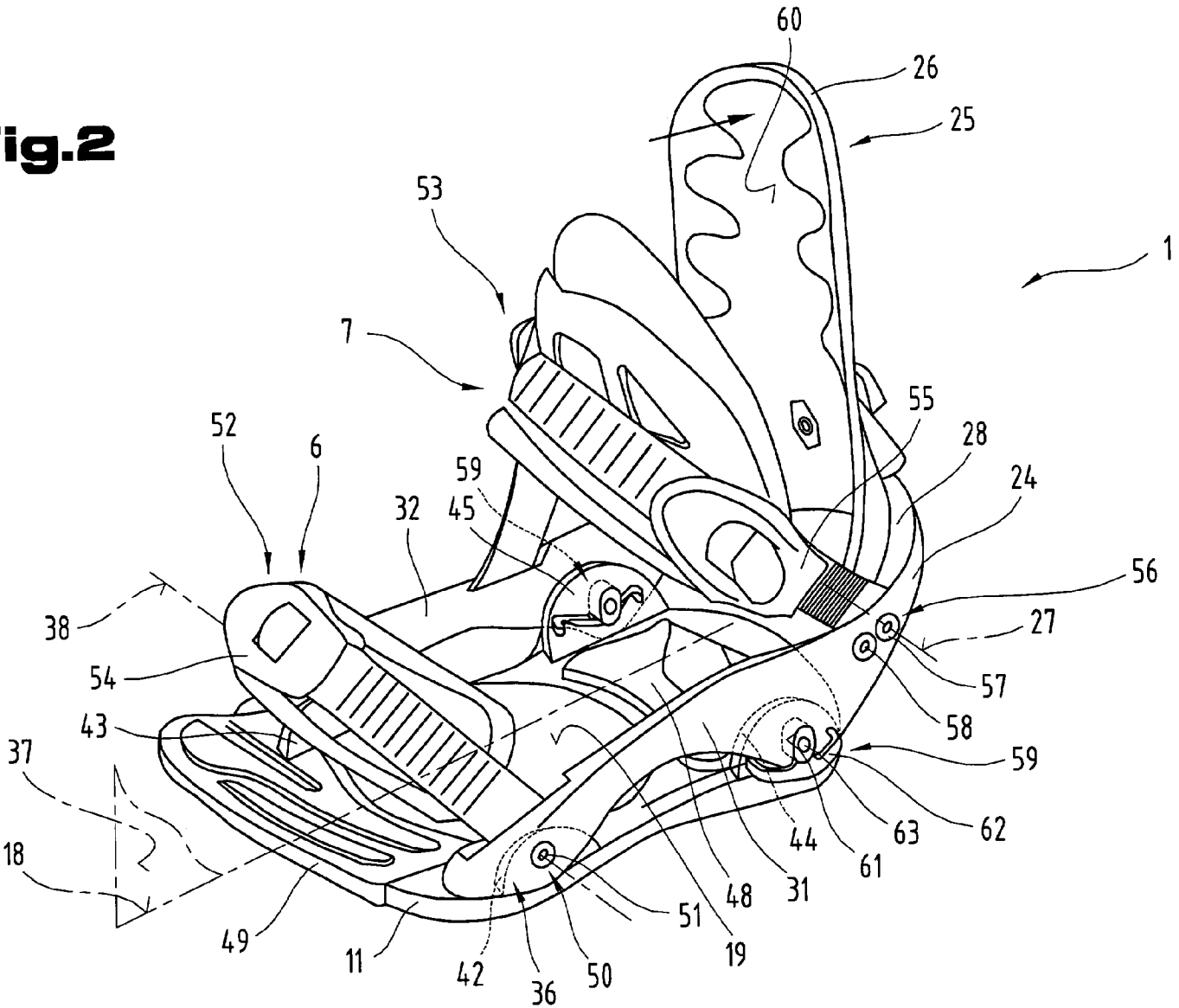
FIG. 2 is a simplified, perspective showing of another embodiment of the snowboard binding with an adjustably mounted support element.

The binding 1 illustrated in FIG. 2 has a pivot bearing 36 whose pivot axis 38 lies more or less in the support region for the balls of the feet or toes of the user's foot above the seating element 49 on the base plate 11.

The illustrated pivot axis 38 is defined by fixing means 50 comprised of conventional screws 51, which extend through the ends of the legs 31, 32 and pivotably connect them to the extensions 42, 43. A front strap arrangement 52 for strapping and loosening the front foot region from the binding 1 is also attached thereto by means of the two fixing means 50 so as to pivot on the base plate 11 about pivot axis 38 to a limited degree. When the binding 1 is in the usage position, this front strap arrangement 52 extends transversely across the front foot region of a user and transversely across the base plate 11. Consequently, the strap arrangement 52 can be adjusted to the individual needs and requirements of a user in terms of the angular position and hence the way in which tensile and compression forces are transmitted to the foot of the user. The pivoting action of the strap arrangement 52 about the pivot axis 38, also makes it easier to get a sports shoe in and out of the binding 1.

The front strap arrangement 52, as well as a rear strap arrangement 53, has a clamping and releasing mechanism 54, 55, preferably in the form of so-called ratchet buckles. These clamping and releasing mechanisms 54, 55 on the strap arrangements 52, 53 provide an a comfortable means of varying the length of the strap arrangements 52, 53 enclosing a region of the sports shoe, thereby adjusting the clamping and retaining force exerted to whatever sports shoe is used. In particular, this enables whatever sports shoe is used to be strapped in the binding 1 and then taken out of the binding 1 again after loosening the clamping and releasing mechanisms 54, 55. Each of the strap arrangements 52, 53 preferably has two strap halves, the overlapping width of which can be fixed by means of the clamping and releasing mechanisms 54, 55 and which can be released again and slid free.

The rear strap arrangement 53, which extends transversely across the instep region of the foot of a user when the binding 1 is used, is preferably articulated on the pivot axis 27 for the back support. This pivot axis 27 is also preferably formed by fixing means 56, in particular by screws 57, pivotably mounting ends of the back support on the legs 31, 32 in the region of the base 28. These fixing means 56 are also used to fix and pivotably attach the rear strap arrangement 53. Accordingly, the rear strap arrangement 53 can also pivot about a pivot axis 27, thereby enabling an adjustment to be made to individual needs or requirements in terms of the points at which force is transmitted to the instep region. In a manner known per se, several receiving bores 58 or oblong orifices may be provided in the support element 24 and/or in the back support for individually adjusting the position and/or orienting the back support relative to the support element 24 and relative to the base plate 11. The region in which forces are transmitted can be selectively and individually adjusted by means of these oblong orifices or receiving bores 58 with the fixing means 56 extending through them.

The essential feature of the binding illustrated in FIG. 2 is that the pivot path of the support element 24 about the pivot axis 38 is elastically resiliently damped during its pivoting motion by a damping mechanism 59. In particular, in a first pivoting adjustment path of the support element 24, the active force of the damping mechanism 59 may not come into play, an elastically resilient stop restriction or absorption effect for the support element 24 is effective only when the support element 24 has reached at least one of the two end regions of the maximum pivot path. By preference, however, the resiliently elastic and rebounding active force of the damping mechanism 59 comes into play over the entire maximum possible pivot path of the support element 24. The damping mechanism 59 comprises an elastically resilient element 62, for example a coil spring assembly, but preferably at least one element made from an elastomeric synthetic material or expanded foam, which is disposed so that it will act within the pivot path of the support element 24. Especially when subjected to compression and/or tensile forces perpendicular to a support surface 60 of the back support, a pivoting motion of the support element 24 will be permitted or initiated about the pivot axis 38 against the bias of a of the damping element arranged inside of pivot path.

The damping element 62 may be a block-shaped element made from an elastomeric synthetic material inserted in an oblong hole 61. Extending through this damping element 62 is a bolt-type connecting element 63 between the support element 24 and the retaining extensions 44 and 45. The support element 24 will therefore only be able to pivot about the pivot axis 38 against the bias of the damping element 62. In particular, the damping element 62 is compressed or stretched when the support frame 24 pivots.

Figure 3:
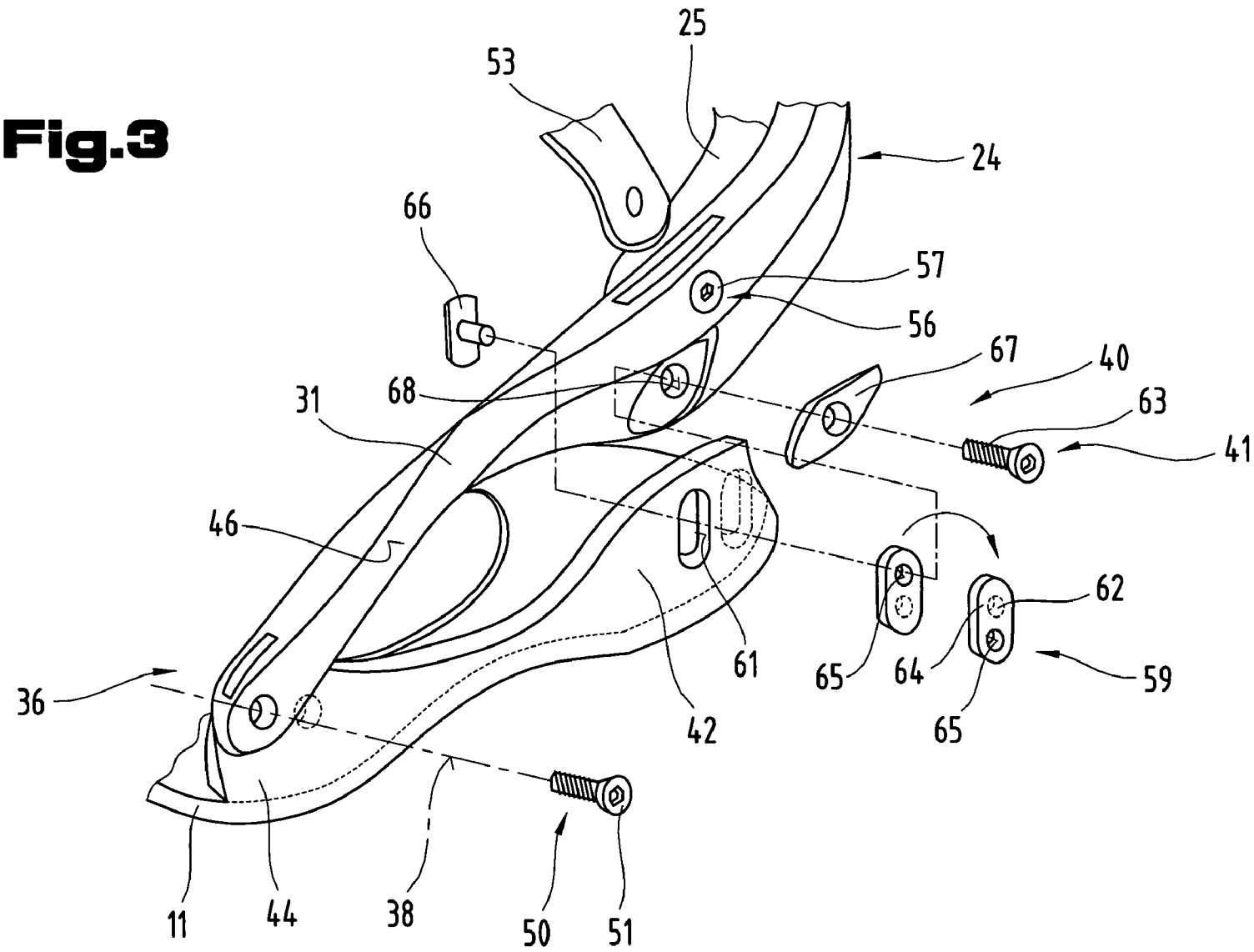
FIG. 3 is a simplified, perspective showing of an embodiment of the pivot bearing and an adjusting and locking mechanism and damping mechanism for the support element.

FIG. 3 provides a an exploded view of another embodiment of a pivot bearing 36 for the support element 24 and a combined adjusting and locking mechanism 40 incorporating a damping mechanism 59. The pivot path will essentially depend on nothing more than an insert part 64 which can be inserted and received in an oblong hole 61.

A particularly simple adjusting and locking mechanism 40 for the desired angular position of the support element 24 about the pivot axis 38 can be obtained if this insert part 64 inserted in the oblong hole 61 is rigid or inflexible. The support element 24 can be adjusted to different angular positions relative to the base plate 11 by providing at least one receiving bore 65, which is eccentrically positioned in the elongate insert part 64. Optionally, several spaced receiving bores 65 may be provided in the inset part 64. The vertical distance of the receiving bore 65 can be varied relative to the base plate 11 simply by varying the position in which the insert part 64 is inserted in the oblong hole 61. A pivot angle of the support element 24 relative to the base plate 11 can be set depending on the different vertical distances in the receiving bore 65. The insert part 64, which can be variably received in the oblong hole 61, and the support element 24 are preferably connected to one another by the bolt-type connecting element 63, usually a screw, extending through them. To obtain an adjustable connection between the support element 24 and the base plate extension 42 that will be functionally reliable in the long term and resistant to breaking, a flanged nut 66 is provided to hold the screw connecting element 63 in place.

A cover element 67 may also be provided, which visually masks an orifice 68 in the support element 24 and/or the oblong hole 61 in the extensions 42, 43. This cover element 67 is also a fixing element, which prevents the insert part 64 from falling out of the oblong hole 61 under the effect of loads.

By simply varying the insertion position of the insert part 64, the position receiving bore 65 can be varied in terms of its vertical distance relative to the base plate 11, thereby serving as an adjusting and locking mechanism 40 for the pivot bearing 36 of the support element 24.

The advantage of providing receiving bores 65 for the bolt-type connecting element 63 in an eccentric arrangement is that the angular position of the support element 24 relative to the base plate 11 can be adjusted by relatively fine degrees, whilst nevertheless acting as a stable adjusting and locking mechanism 40 capable of withstanding high loads.

Alternatively, it would also be possible to provide several spaced bores and/or oblong holes in the legs 31, 32 of the support element 24 and/or in the extensions 42, 43 on the base plate 11, in which the connecting element 63 can be selectively inserted to obtain a different angular position. This being the case, individual receiving bores are preferably arranged in an arc about the pivot axis 38 or an oblong hole 61 may extend arcuately about the pivot axis 38.

The insert part 64 may also be made from a soft elastic material, for example an elastomer, offering a simple way of providing a damping mechanism 59 for the pivoting motions of the support element 24 about the pivot bearing 36. In this case, the bolt-shaped connecting element 63 is surrounded by or inserted in the soft elastic material of the insert part 64, thereby enabling the soft elastic insert part 64 to be compressed and/or turn under the action of sufficiently high adjusting forces, resulting in a limited and damped pivoting motion of the support element 24 together with the back support about the pivot axis 38.

Another advantage of such an insert part 64 resides in the fact that it offers the option of selectively providing an adjusting and locking mechanism 40 or a damping mechanism 59. Using elastic insert parts 64 of a different hardness provides the option of adapting to individual desires and requirements in terms of the damping characteristic of the damping mechanism 59. Another advantage resides in the fact that it provides a simple option of switching from a rigid adjusting and locking mechanism 40 to a damping mechanism 59 for the support element 24 or a combination of an adjusting and locking mechanism 40 and a damping mechanism 59.

It would also be possible to provide the oblong hole 61 in the legs 31, 32 of the support element 24 and at least one orifice 68 in the extensions 42, 43 of the base plate 11.

Also of advantage is the fact that the capacity of the support element 24 to pivot relative to the base plate 11 can be selectively released and locked by means of a pre-tensioning force between the support element 24 and the extensions 42, 43, adjustably applied by means of connecting element 63 which can be operated without tools. In particular, if the connecting element 63 is screwed in sufficiently tightly, a clamping and/or catch connection 41 can be obtained, which totally prevents any movement of the support frame 24. When the connecting element 63 is loosened, the ability of the support element 24 to move relative to the base plate 11 is permitted within pre-defined limits and preferably in a manner whereby any movement is damped.

Instead of a double-acting damping mechanism 59, in other words one which acts in opposite directions, it is also possible to provide the receiving bore 65 through which the connecting element 63 is inserted in the outermost peripheral region of the insert part 64 so that a damping adjustability of the support element 24 is provided in one pivoting direction only. By preference, a pivoting motion of the support frame 24 is blocked in a direction remote from the base plate 11 and a relative adjustability is permitted in a position closer to the base plate 11 against the bias of the damping insert part 64 of the damping mechanism 59.

Irrespective of the above, however, the damping characteristic of the damping mechanism 59 and/or the maximum pivot path of the support element 24 may be adjusted by varying a radial distance of the damping element 62 from the pivot axis 38.

Figure 4:
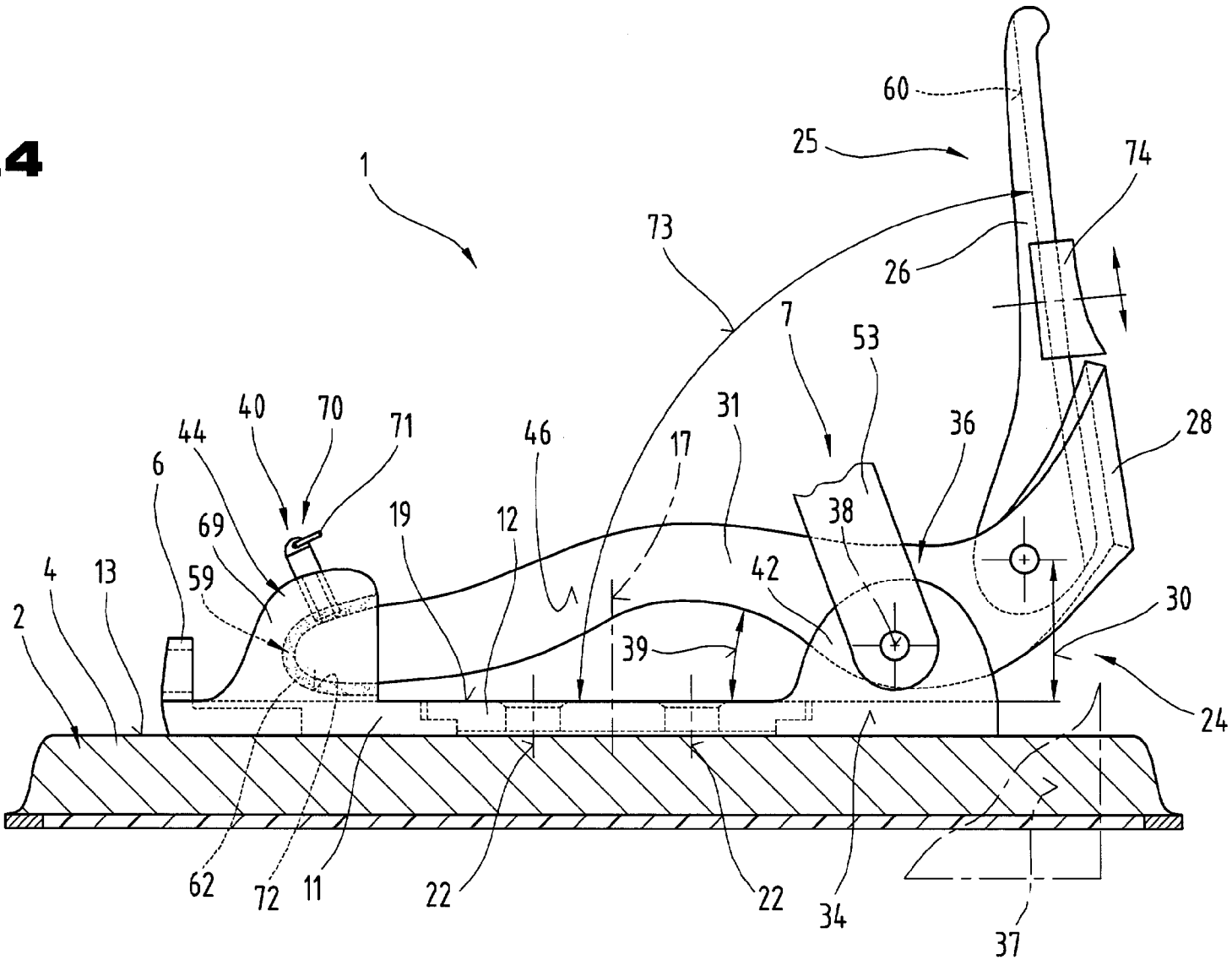
FIG. 4 shows another embodiment of a snowboard binding with a differently arranged pivot bearing and an adjusting mechanism for the adjustment path and for the damping characteristic of the support element.

FIG. 4 illustrates U-shaped support element 24 for the back support with the pivot bearing 36 positioned close to the base 28. In other words, the pivot axis 38 of the pivot bearing 36 is disposed close to the curved region of the legs 31, 32 merging with the base 28 of the U-shaped support element 24. In this embodiment, a first leg length starting from the pivot axis 38 in the direction towards the base 28 is shorter than a second leg length starting from the pivot axis 38 in the direction towards the ends of the legs 31, 32. Consequently, the embodiment illustrated in FIG. 4 has a totally different ratio of pivot path to force than the embodiments described above. Thus, relatively high compression and tensile forces must act on the back support in order to produce a pivoting action of the support element 24 against the bias of a damping mechanism 59 provided in the region of the leg ends. On the other hand, small pivot paths of the base section of the support element 24 in the direction perpendicular to the standing plane 19 result in relatively longer pivot paths of the leg ends in this direction.

The illustrated damping mechanism 59 is a thrust bearing 69 which co-operates with the leg ends remote from the base 28. The maximum possible damping path and/or the damping characteristic or hardness of the damping element 62 is adjustable. To this end, the thrust bearing 69 has an adjusting element 70, by means of which the pre-tensioning or degree of compression of damping element 62 and/or the maximum possible pivot path for the support element 24 can be varied. This adjusting element 70 may be a lever or threaded arrangement, for example, by means of which the maximum freedom of movement of the leg ends can be adjusted within a pre-defined range and/or the hardness of the damping element 62 can be adjusted. In the embodiment illustrated, the adjusting element 70 is a screw element, provided in the form of an adjustable stop in the pivot path of the support element 24.

The adjusting element 70 is a manually operable lever handle 71, by means of which the hardness of the damping mechanism and/or the maximum pivot path of the support element 24 can be varied without the need for tools.

In the embodiment illustrated, the thrust bearing 69 comprises a receiving slit 72 for the leg ends of supporting element 24. The ends of the legs 31, 32 are partially inserted in a respective receiving slit 72 and can be pivoted to a certain degree therein against the bias of the damping element 62 in the direction perpendicular to the base plate 11. In other words, a width of the receiving slit 72 as measured perpendicular to the standing plane 19 is greater than the leg ends of the support element 24 inserted therein, permitting a limited displacement between the ends of the support element 24 and the thrust bearing 69 fixedly mounted on the base plate 11. A width of the receiving slit 72 as measured perpendicular to the vertical plane 37 substantially corresponds to a thickness of the leg ends so that the leg ends are positioned so as to be immobile in the transverse direction and the distance between them is therefore fixed.

The thrust bearing 69 is preferably provided on the extensions 44, 45 arranged at the forward end of the base plate 11. In particular, the receiving slits 72 for the leg ends may be defined by two extensions 44, 45 spaced at a slight distance apart from one another.

Alternatively or in combination with the described damping mechanism 59, the natural elasticity of the rear strap arrangement 53 may provide the damping mechanism. To this end, the strap-shaped element of the strap arrangement 53 is attached on the one hand to the extensions 42, 43 and is additionally, at a distance therefrom, connected to the pivotably mounted support element 24. This mechanical connection between the support element 24 and the extensions 42, 44 afforded by the elastically flexible and rebounding strap arrangement 53 provides a damping action with regard to the relative displaceability between the support element 24 and the base plate 11.

The binding mechanism 1 has a first coupling part 6 provided in the form of a rigid retaining element, for example a lug or a retaining pin, for the toe region of a sports shoe and the other coupling part 7 is a strap arrangement 53 which is flexible to a greater or lesser degree for fixing the instep region of a sports shoe.

The pivotable bearing of the support element 24 may also be used with binding types in which the coupling parts are disposed in the lateral peripheral region of the base plate 11, which can be selectively engaged with the side regions of a sports shoe or disengaged therefrom.

The legs 31, 32 have a section between the pivot bearing 36 and the front end of the support element 24, which is convexly curved relative to the base plate. This enables boundary walls 46, 47 to be formed with a sufficient support height in the middle of the base plate 11 and these boundary walls 46, 47 may be relatively low at the end of the base plate 11.

The angle of inclination 73 of the support surface 60 of the back support relative to the standing plane 19 for a sports shoe may be varied by pivoting support element 24. This angle of inclination 73 can also be varied by damping element 62 under the action of sufficiently high loads. In particular, the impacts which occur in pulses during travel can be transmitted to the foot and the calf of the user in a reduced form via the pivotable support element 24.

Preferably, at least one adjustable stop element 74 is provided on the back support or on the support element 24, by means of which the inclination of the back support relative to support element 24 can be adjusted within a relatively broad adjustment range. This stop element 74 can be adjusted and fixed in the vertical direction by means of a screw or any other clamping or catch connection so that different maximum angles of inclination 73 between the back support and the base plate 11 or the support element 24 can be set. The stop element 73, therefore limits the maximum pivot angle between the back support and the support element 24, whereas the pivot bearing 36 permits a change in the angle of inclination 73 of the back support due to the ability of the support element 24 to pivot about the pivot axis 38.

Figure 5:
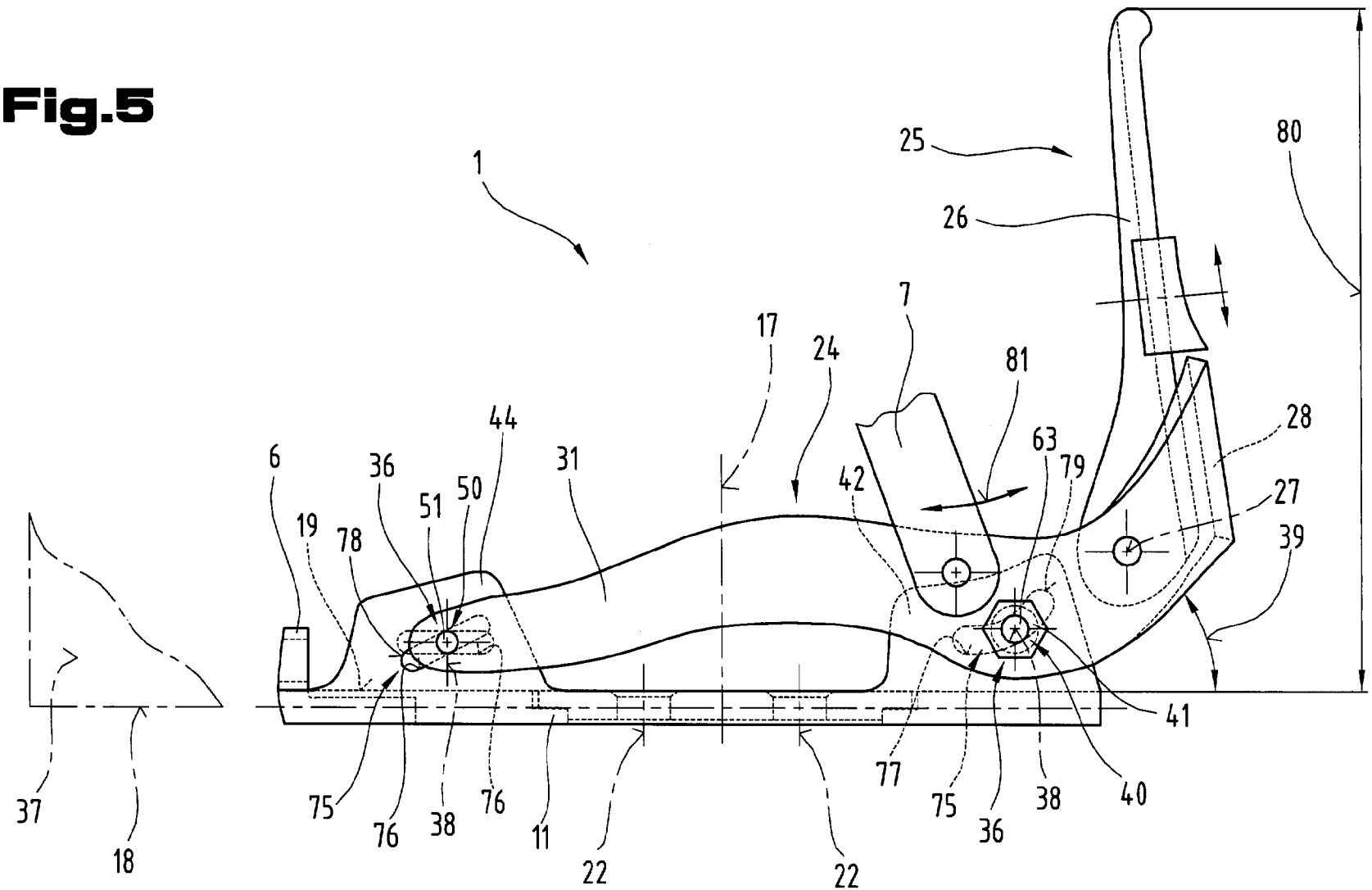
FIG. 5 shows another embodiment of a snowboard binding in which the support element may be adjusted in rotation and translation relative to the base plate.

FIG. 5 shows a snowboard binding comprising two pivot bearings 36 spaced at a distance apart from one another and extending in the direction of the longitudinal axis 18 for the support element 24. More specifically, two pivot bearings 36 are provided for each of the two legs 31, 32 of the support element 24. The forward or first pivot bearing 36 is preferably disposed close to the ends of the legs 31, 32, i.e. close to the open ends of the U-shaped support element 24. The rearward pivot bearing 36 is preferably positioned in the transition region between the legs 31, 32 and the semicircular base 28 of the support element 24. Guide mechanisms 75 are provided for the two pivot bearings 36. This enables a combined adjustment of the support element 24 relative to the base plate 11 in rotation and translation. The two guide mechanisms 75—which, like the pivot bearings 36, are arranged in a substantially symmetrical arrangement relative to the longitudinal axis 18—have oblong cutouts 76, 77 permitting an adjustment range for the support element 24 extending in a straight and/or curved path relative to the base plate 11. These cutouts 76, 77 are illustrated as oblong orifices 78, 79 in the extensions 42 to 45. Instead of oblong cutouts 76, 77 or orifices 78, 79, it would naturally also be possible to provide oval or circular holes to provide a guide mechanism 75 and a pivot bearing 36 with a defined adjustment range for the support element 24 relative to the base plate 11.

To enable a displacement of the support element 24 relative to the base plate 11, the pivot bearings have preferably fixing means 50 and bolt-type connecting element 63 disposed in oblong orifices 78, 79 so as to be adjustable and fixable in the desired position. Preferably, a diameter of the screws 51 or the bolt-type connecting elements 63 substantially corresponds to a width of the oblong orifices 78, 79 so that the screws 51 or the bolt-type connecting elements 63 are able to penetrate the orifices 78, 79 transversely to their longitudinal extension. The longitudinal extension of the orifices 78, 79 extends in the direction of the binding longitudinal axis 18 and/or in the direction of the vertical binding axis 17. In other words, the guide mechanisms 75 extend horizontally and/or vertically or at an incline to the standing plane 19 by reference to the vertical plane 37. In a preferred embodiment, at least one of the guide mechanisms 75 is arcuately curved and has a center point above base plate 11.

A significant advantage of the guide mechanisms 75, which permit an adjustment of the support element 24 relative to the base plate 11 in the longitudinal and/or vertical direction, resides in the fact that the binding 1 has a more extensive setting or adjustment range, rendering it relatively flexible and capable of being adapted to different requirements or usage conditions. Especially if the guide mechanisms 75 permit a markedly vertical adjustability of the support element 24 relative to the base plate 11, a support height 80 of the back support 26 can be adjusted within a relatively extensive adjustment range. In particular, if the guide mechanisms 75 rise at an incline, it will be possible to vary the support height 80 of the back support 26 by up to 5 cm without any difficulty. Likewise, if the guide mechanisms 75 are dimensioned accordingly, it will be possible to make width adjustments of up to 5 cm to the support element 24 in the direction of the longitudinal axis 18 without any difficulty. The orientation or shape of the cutouts 76, 77 of the guide mechanisms 75 is preferably selected so that a combined length and height adjustment can be made to the support element 24 relative to the base plate 11. One possible path of this adjusting motion is indicated by a double arrow 81.

In order to prevent the support element 24 from moving freely relative to the base plate 11, an adjusting and locking mechanism 40 is assigned to at least one of the combined pivot bearing and guide mechanisms 36, 75. This adjusting and locking mechanism 40 for fixing the desired relative position of the support element 24 together with the back support relative to the base plate 11 is preferably provided in the form of a conventional clamping and/or catch connection 41. In the most basic design, this clamping and/or catch connection 41 will consist of a threaded arrangement which can be loosened or tightened as required, for example a screw and nut assembly. Alternatively or in combination with this rigid adjusting and locking mechanism 40, it would also be possible to provide a damping mechanism which is adjustable in terms of its hardness, by means of which the support element 24 can be retained in an elastically resilient manner with a pre-defined retaining force in the initial position or non-operating position.

It would also be possible, within the scope of the invention, for the back support to be integrally formed on the support element 24, requiring no articulated connection 27. The adjusting and locking mechanism 40 may also be an eccentric or cam lever arrangement which can be operated without tools.

Figure 6:
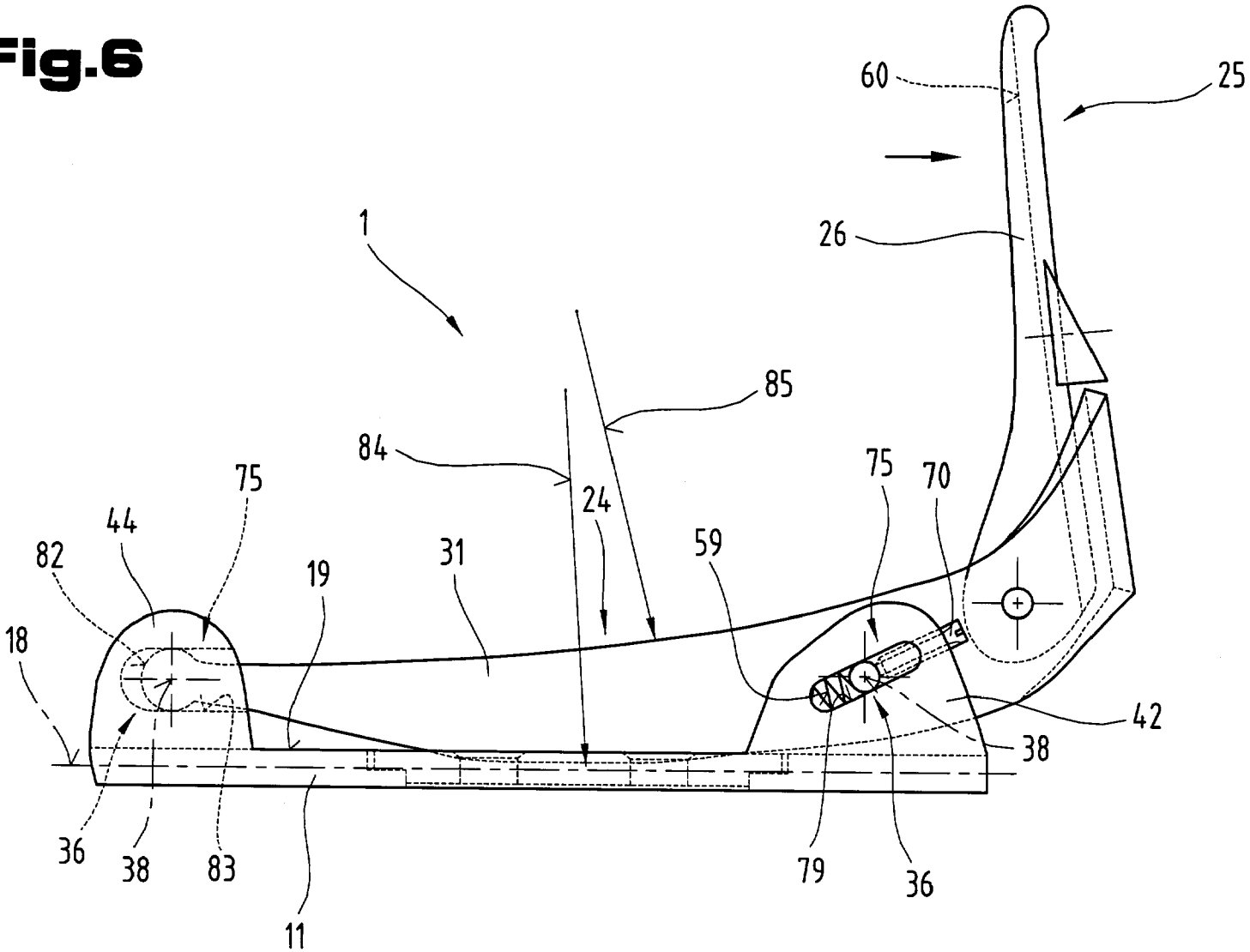
FIG. 6 is a simplified, schematic side view of a support element with rounded guide surfaces on the ends of its legs as pivot bearing for the support element.

FIG. 6 also illustrates a binding 1, in which the support element 24 can be adjusted relative to the base plate 11 in rotation and translation. At least one of the pivot bearings 36, in particular the forward pivot bearing 36, comprises rounded guide surfaces 82 in the ends of the legs 31, 32. These guide surfaces 82 define the pivot axis 38 for the support element 24. This pivot bearing 36 formed by the rounded, in particular circular guide surfaces 82, may operate in a linear or curved guide mechanism 75 and thus provide a combined displacement in rotation and translation for the support element 24 relative to the base plate 11. A diameter of a circular, rounded front end of the legs 31, 32 substantially corresponds to a width of an oblong recessed guide slit 83, open at one side, in the forward extensions 44, 45 of the base plate 11. This ensures a pivoting action about the pivot axis 38 and simultaneously permits a linear relative displacement of the support element 24 relative to the base plate 11 by means of the guide slits 83 for the leg ends forming the guide mechanisms 75. The rounded ends of the legs 31, 32 may simply be inserted in the guide slits 83 on the base plate 11 and the leg ends will then be held in position transversely to the longitudinal direction 18. However, the support element 24 may be displaced in the direction of the longitudinal axis 18.

The guide slits 83 for receiving rounded ends of the legs 31, 32 simplifies assembly of the binding 1 and in particular obviates the need for any additional fixing means, such as screws for example, for retaining the ends of the support element 24 in position on the base plate 11. The problem-free design of the generously dimensioned guide surfaces 82 in particular makes for a highly stable pivot bearing 36.

Spaced at a distance apart from the first or forward pivot bearing 36 and guide mechanism 75 is the rearward pivot bearing 36 and guide mechanism 75 for the support element 24. This second guide mechanism 75 is an obliquely extending orifice 79 in the rearward extensions 42, 43 of the base plate 11. A pin or bolt projecting out from the legs 31, 32 of the support element 24 is inserted through these orifices 79 and is secured therein in an elastically adjustable or fixed arrangement. In the embodiment illustrated, a damping mechanism 59 is provided, which opposes the pivoting and sliding movements of the pivot bearings 36 with a defined mechanical resistance. An adjusting element 70 may optionally be provided, for example a screw assembly, by means of which the hardness of the damping mechanism 59 can be varied. Alternatively, this adjusting element 70 may also be provided as a means of locking the desired relative position of the support element 24 relative to the base plate 11 and cut out any damping action between the support element 24 and the base plate 11.

When a load is applied perpendicular to the support surface 60 of the back support, the support element 24 is able to slide forwards in the guide mechanisms 75 in the direction of the longitudinal axis 18 and pivot about the pivot axes 38 of the pivot bearings 36 against the action of the damping mechanism 59.

Optionally, the two pivot axes 38 of the pivot bearings 36 may extend in the same radial distance about a common centre point, bringing about an arcuate pivoting of the support element 24 about this common centre point. To this end, the guide surfaces of the guide mechanisms 75 must have the same radius of curvature and a common centre point. This results in a swinging pivoting action of the support element 24 about this central centre point disposed above the standing surface 19.

In this embodiment, the support element 24 extends in a continuous curved arrangement as seen in the side view illustrated in FIG. 6, the centre points of the radii of curvature 84, 85 of the support element 24 always lying above the standing plane 19.

Figure 7:
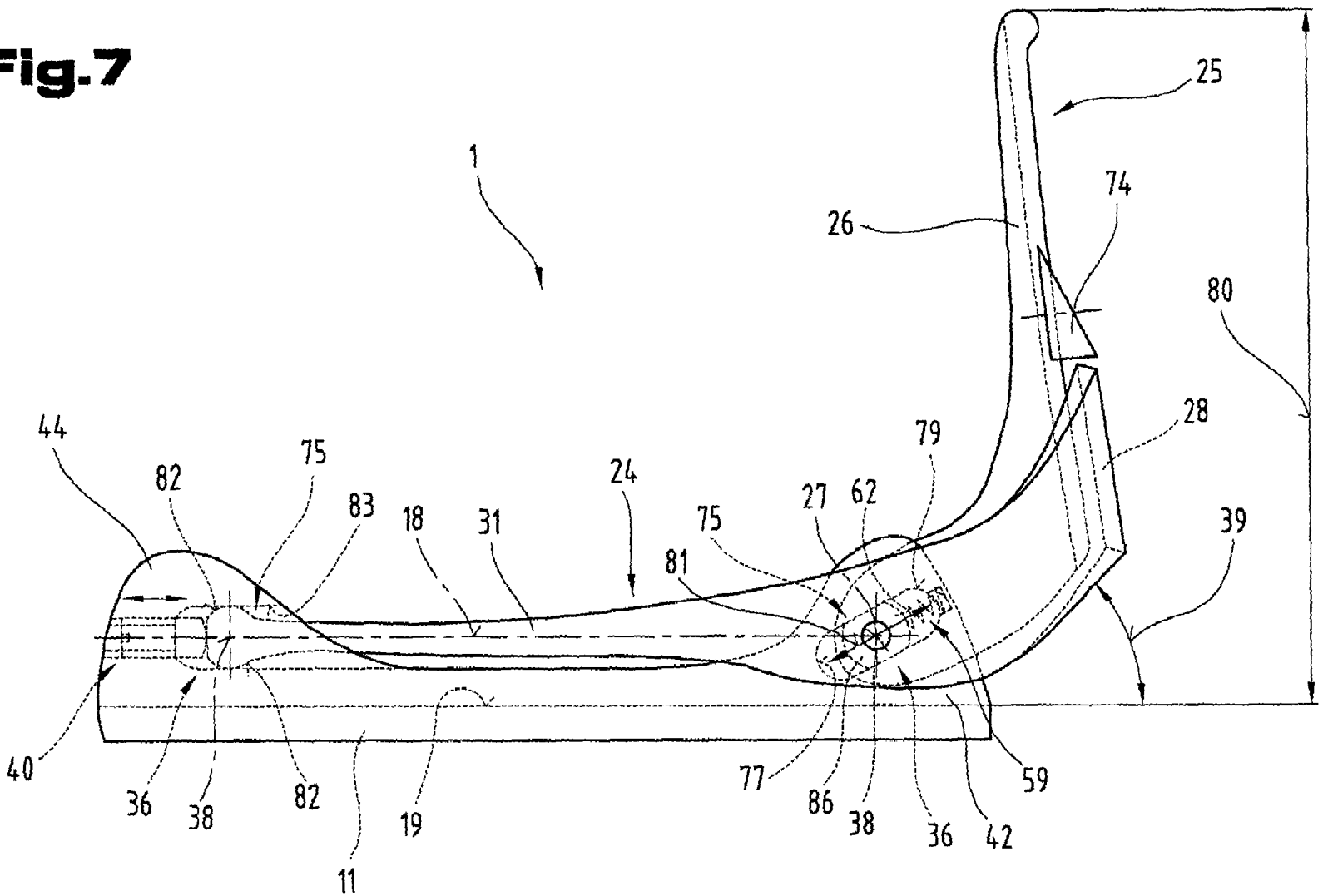
FIG. 7 is a simplified, schematic side view of another embodiment of a combined bearing mechanism for displacing the support element in rotation and translation relative to the base plate.

Similarly, in binding 1 of FIG. 7, the rounded guide surfaces 82 in the free ends of the legs 31, 32 are disposed in an oblong guide slit 83 in the extensions 44, 45 of the base plate 11. As a result of the co-operation between the guide slits 83 and the guide surfaces 82, the ends of the legs 31, 32 are retained in position in the extension 44, 45 in all directions transversely to the longitudinal axis 18.

The forward sliding and pivoting bearing for the support element 24 is provided with an adjusting and locking mechanism 40 for adjusting and fixing the desired relative position of the support element 24 relative to the base plate. This adjusting and locking mechanism 40 is a screw assembly, for example a worm screw, which affects the angular position of the support element 24 and the support height 80 of the back support depending on the depth to which it is screwed into the extension 44, 45. The deeper the adjusting and locking mechanism 40 is screwed in, the more rearward the support element 24 is pushed from the base plate 11 and simultaneously raised at least in the rearward region of the binding 1 relative to the standing plane 19 of the base plate 11. This displaceability of the support element 24 relative to the base plate 11 is guaranteed by the pivot bearing 36 and the guide mechanism 75 in the rearward region of the base plate 11. In order to keep the surface contact in the translating guides as light as possible, at least the rearward guide mechanism 75 has a separate sliding block 86 in its oblong cutout 77. The pivot axis 38 extends through this sliding block 86 and thus receives the pivot bearing 36 in a load-bearing arrangement. The obliquely rising orientation of the oblong cutout 77, i.e. oblong orifice 79, permits a relative displacement of the support element 24 in the lengthwise and vertical directions relative to the base plate 11, as schematically indicated by the double arrow 81.

To prevent the support element 24 from freely lifting off the base plate 11, pivot bearing 36 includes a damping mechanism 59, for example a coil spring, the damping element 62 forcing the pivot axis 38 to a position immediately adjacent to the standing plane 19, but which can be adjustably restricted by the adjusting and locking mechanism 40.

In this embodiment, the back support 26 is mounted directly on the rearward pivot axis 38. In other words, the pivot axis 27 and the rearward pivot axis 38 coincide. Again, the back support is moved simultaneously when the relative position of the support element 24 is varied. The support element 24 in this case no longer serves the basic function of a support for the pivotably mounted back support but instead the base 28 of the support element 24 serves as a stop restriction for the angular positioning of the back support relative to the support element 24. The base 28 acts as a stop surface of the adjustably mounted stop element 74 on the back support.

Figure 8:
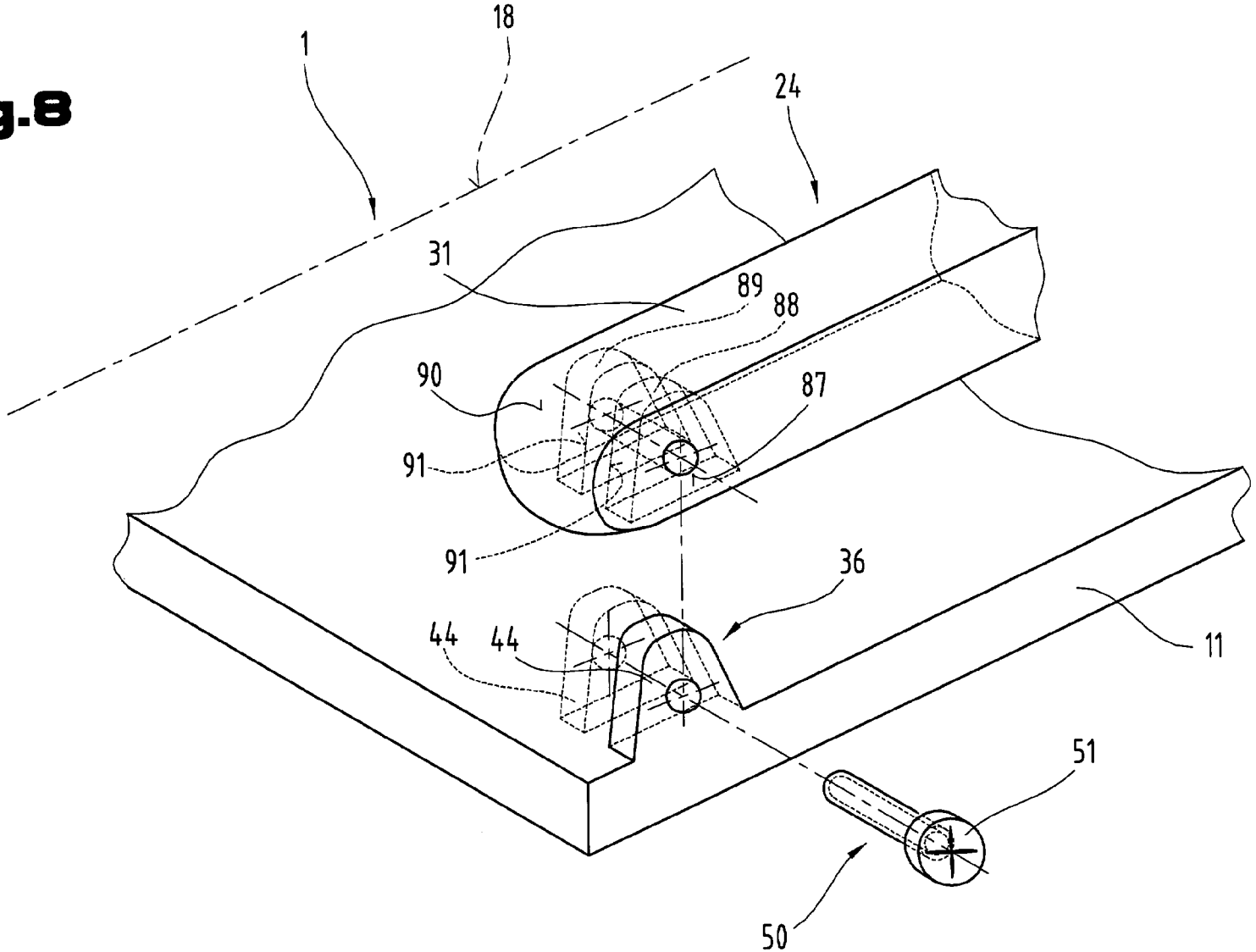
FIG. 8 is a simplified, perspective diagram showing a bearing mechanism for the leg ends of the support element for adjusting to different shoe and sole widths.

FIG. 8 provides a schematic illustration of the front part region of the binding 1. The design may be used in conjunction with the binding 1 described above or may be used as a separate design. For the sake of simplicity, only one of the legs, i.e. the leg 31, of the support element 24 is shown in the embodiment illustrated. Naturally, the design described below could be provided for both legs of the support element 24.

In this instance, the end of the leg 31 has at least two, preferably several bearing points 87, 88, 89, 90 spaced at a distance from one another transversely to the longitudinal axis 18. The extension 44 on the base plate 11 may be selectively connected to at least one of the bearing points 87 to 90 in order to set up a rigid retaining system or provide the pivot bearing 36 for the support element 24. By means of the bearing points 87, 88, 89, 90, which may be used selectively, spaced apart from one another transversely to the longitudinal axis 18, different receiving widths may be left between the legs of the support element 24 for a specific sports shoe. In particular, the clearance spacing between the two legs of the support element 24 may be adapted in stages so as to suit the width of the shoe or the width of its sole as best possible. If simultaneously using the lateral boundary surfaces of the leg 31 as bearing points 87, 90 and by providing two receiving slits or recesses 91 to form the bearing points 88, 89 on the leg 31, four pivot bearings 36 can be provided at a distance apart from one another transversely to the longitudinal axis 18, or alternatively as rigid bearings, for leg 31 of the support element 24.

In one possible embodiment, several spaced extensions 44 may be provided on the base plate 11 transversely to the longitudinal direction 18 and/or several spaced matching orifices or recesses 91 may be provided transversely to the longitudinal direction 18 in at least one of the two legs. It would also be possible to provide the extensions 44 and recesses 91 in an inverse layout.

At least one of the lateral boundary surfaces on at least one of the two legs may even form the innermost and/or the outermost bearing points 87, 90 for setting the narrowest and/or broadest distance between the legs of the support element 24.

The setting of the leg distance may be fixed by a fixing means 50 connecting the extension 44 and the respective leg, for example in the form of a screw 51.

The invention claimed is:

1. A snowboard binding comprising (a) a base plate for supporting a sports shoe, the base plate having a longitudinal axis, (b) a front extension in a peripheral region of the base plate on each side of the longitudinal axis, (c) a U-shaped support element comprised of a base and two legs, each extension retaining an end of a respective one of the legs, the support element (1) supporting a high-back disposed in the region of the base and pivotable to a limited degree, (d) a pivot bearing mounting the support element so as to be pivotable into desired angular positions relative to the base plate in a limited pivot path about a pivot axis extending transversely to the longitudinal axis and substantially parallel to the base plate, and (e) an adjusting and locking mechanism for fixing the support element in a desired one of the angular positions relative to the base plate.

2. The snowboard binding as claimed in claim 1, comprising an elastically resilient damping mechanism for rebounding the support element into a pre-defined angular position relative to the base plate.

3. The snowboard binding as claimed in claim 1, wherein the support element is a stop restriction for the back support mounted on the extensions of the base plate.

4. The snowboard binding as claimed in claim 1, wherein the pivot bearing for the support element is provided at the ends of the two legs remote from the base.

5. The snowboard binding as claimed in claim 1, wherein the pivot bearing is arranged close to the base of the U-shaped support element.

6. The snowboard binding as claimed in claim 1, wherein the adjusting and locking mechanism is disposed at a distance from the pivot bearing.

7. The snowboard binding as claimed in claim 1, wherein at least one resiliently elastic damping element is arranged inside the limited pivot path of the support element, the damping element permitting a pivoting of the support element about the pivot axis against the bias of the damping element when subjected to compression forces perpendicular to a support surface of the back support.

8. The snowboard binding as claimed in claim 1, wherein the adjusting and locking mechanism is disposed at the end of the base plate nearest the base.

9. The snowboard binding as claimed in claim 1, wherein the legs of the support element extend continuously from a rearward to a forward region of the base plate.

10. The snowboard binding as claimed in claim 1, wherein the legs of the support element are curved convexly relative to the base plate.

11. The snowboard binding as claimed in claim 1, wherein the base plate has rear extensions in the peripheral region of the base plate for forming the pivot bearing and the front extensions retaining the legs are arranged at a distance therefrom for receiving the adjusting and locking mechanism.

12. The snowboard binding as claimed in claim 1, wherein the adjusting and locking mechanism comprises an insert part in an oblong hole for adjusting the angular position of the support element relative to the base plate within a plane perpendicular to the base plate.

13. The snowboard binding as claimed in claim 12, wherein the insert part is a damping element which is resiliently elastically flexible and rebounds when the binding is subjected to loads.

14. The snowboard binding as claimed in claim 1, further comprising at least one connecting element which can be operated without tools for securing and releasing the sports shoe.

15. The snowboard binding as claimed in claim 1, wherein the pivot axis is defined by a screw bolt.

16. The snowboard binding as claimed in claim 1, wherein the adjusting and locking mechanism comprises a screw bolt connecting element between the support element legs and the base plate extensions, the connecting element being adjustable to a limited degree in an oblong hole.

17. The snowboard binding as claimed in claim 1, wherein the pivot bearing comprises rounded guide surfaces on the ends of the legs engaging matching arcuately curved bearing surfaces on the base plate extensions.

18. The snowboard binding as claimed in claim 2, comprising an adjusting element for varying a maximum hardness of the damping mechanism.

19. The snowboard binding as claimed in claim 18, wherein the adjusting element is an adjustable stop element for the support element legs, and/or a positioning means for varying the pre-tensioning or damping characteristic of the damping mechanism.

20. The snowboard binding as claimed in claim 18, wherein hardness of the damping mechanism and/or the maximum pivot path of the support element is adjustable by varying a radial distance of the damping mechanism from the pivot axis.

21. The snowboard binding as claimed in claim 18, wherein the adjusting element has a manually operable handle for varying the hardness of the damping mechanism and/or the maximum pivot path of the support element.

22. The snowboard binding as claimed in claim 1, comprising two of said pivot bearings mounting the support element on the base plate and spaced apart from one another in the direction of the longitudinal axis, and guide mechanisms for the pivot bearings.

23. The snowboard binding as claimed in claim 22, wherein the support element can be adjusted in rotation and translation relative to the base plate by the pivot bearings and guide mechanisms.

24. The snowboard binding as claimed in claim 22, wherein at least one of the guide mechanisms rises from the ends of the legs in a direction towards the base of the support element.

25. The snowboard binding as claimed in claim 22, wherein the guide mechanisms are arcuately curved and have a center point above the base plate.

26. The snowboard binding as claimed in claim 22, wherein the guide mechanisms are cutouts or orifices in the extensions, and the pivot bearings have bolts disposed therein.

27. The snowboard binding as claimed in claim 22, comprising slide blocks receiving pivot axes adjustably mounted in the guide mechanisms.

* * * * *